United States Patent [19]

Forester

[11] Patent Number: 4,828,674

[45] Date of Patent: May 9, 1989

[54] METHOD FOR CONTROLLING FOULING DEPOSIT FORMATION IN A LIQUID HYDROCARBONACEOUS MEDIUM

[75] Inventor: David R. Forester, Spring, Tex.

[73] Assignee: Betz Laboratories, Inc., Trevose, Pa.

[21] Appl. No.: 177,252

[22] Filed: Apr. 4, 1988

[51] Int. Cl.[4] ..... C10G 9/16

[52] U.S. Cl. ..... 208/48 AA; 208/188; 252/400.2; 252/33

[58] Field of Search ..... 252/400.2, 32.7 E, 33, 252/389.22; 208/48 R, 48 AA, 187, 188

[56] References Cited

U.S. PATENT DOCUMENTS 2,916,454 12/1959 Bradley et al. ..... 252/42.7

3,271,296 9/1966 Gonzalez ..... 208/48 AA 4,024,051 5/1977 Shell et al. ..... 208/187 X 4,123,369 10/1978 Miller et al. ..... 252/33 X 4,556,476 12/1985 Miller et al. ..... 208/48 AA

*Primary Examiner*—Glenn Caldarola

*Attorney, Agent, or Firm*—Alexander D. Ricci; Bruce E. Peacock

[57] ABSTRACT

A method for controlling the formation of fouling deposits in a liquid hydrocarbonaceous medium during processing at elevated temperatures is disclosed. The method comprises adding to said medium an antifoulant compound comprising an alkaline earth alkyl phosphonate phenate sulfide, an alkyl phosphonate phenate sulfide, an amine neutralized alkyl phosphonate phenate sulfide, or mixtures thereof.

18 Claims, No Drawings

METHOD FOR CONTROLLING FOULING DEPOSIT FORMATION IN A LIQUID HYDROCARBONACEOUS MEDIUM

FIELD OF THE INVENTION

The present invention pertains to a method for providing antifouling protection for a liquid hydrocarbonaceous medium, such as a petroleum hydrocarbon or petrochemical, during processing thereof at elevated temperatures.

BACKGROUND OF THE INVENTION

In the processing of petroleum hydrocarbons and feedstocks such as petroleum processing intermediates, and petrochemicals and petrochemical intermediates, e.g., gas, oils and reformer stocks, chlorinated hydrocarbons and olefin plant fluids such as deethanizer bottoms, the hydrocarbons are commonly heated to temperatures of 100° to 1000° F., frequently from 600°–1000° F. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel (such as bars, plate, coils, as examples) of carbon black.

SUMMARY OF THE INVENTION

I have found that alkly phosphonate phenate sulfides, alkaline earth alkyl phosphonate phenate sulfides, and amine neutralized alkyl phosphonate phenate sulfides function effectively at inhibiting fouling deposit formation in liquid hydrocarbon mediums. In accordance with the invention, one or more of such compounds are admitted to the desired liquid hydrocarbonaceous medium in an amount of from 0.5–10,000 ppm to inhibit fouling and deposit formation that would otherwise occur. These antifoulant compounds are preferably added to the liquid hydrocarbon medium during high temperature treatment thereof.

PRIOR ART

Over the years, a variety of products have been provided by various chemical suppliers to inhibit deposit formation and fouling in petroleum hydrocarbon or petrochemical mediums. Particularly successful antifoulants are the polyalkenylthiophosphonic acid esters disclosed in U.S. Pat. No. 4,578,178 (Forester), of common assignment herewith.

Other patents in the antifoulant field which may be of interest include: U.S. Pat. No. 4,024,051 (Shell) disclosing the use of inorganic phosphorus containing acid compounds and/or salts thereof as antifoulants; U.S. Pat. No. 3,105,810 (Miller) disclosing oil soluble alkaryl sulfur containing compounds as antifoulants; U.S. Pat. No. 4,107,030 (Slovinsky et al) disclosing sulfonic acid amine salt compounds as antifoulants; U.S. Pat. No. 3,489,682 (Lesuer) disclosing methods for preparing metal salts of organic phosphorus acids and hydrocarbon substituted succinic acids; and U.S. Pat. No. 2,785,128 (Popkin) disclosing methods for preparing metal salts of acidic-phosphorus-containing organic compounds.

U.S. Pat. Nos. 3,437,583 (Gonzalez); 3,567,623 (Hagney); 3,217,296 (Gonzalez); 3,442,791 (Gonzalez) and 3,271,295 (Gonzalez); 3,135,729 (Kluge and LaCoste); 3,201,438 (Reed) and 3,301,923 (Skovronek) may also be mentioned as being of possible interest.

The alkyl phosphonate phenate sulfides and the preferred alkaline earth alkyl phosphonate phenate sulfides used as antifoulants in accordance with the invention are not new. These materials are described in U.S. Pat. No. 4,123,369 (Miller et al). However, the U.S. Pat. No. 4,123,369 Miller et al disclosure discloses that such materials are useful in lubricating oil compositions. In contrast, the present invention employs these compounds to inhibit fouling in liquid hydrocarbon mediums such as in petroleum hydrocarbons or petrochemicals. Studies have shown that many compounds known to be useful as lubricating oil detergent-dispersants do not adequately function as process antifoulants.

DETAILED DESCRIPTION OF THE INVENTION

I have found that alkyl phosphonate phenate sulfides provide significant antifoulant efficacy when compared with several presently available antifoulants.

specifically, the antifoulants of my invention are formed via reaction of an alkyl phenol of the formula

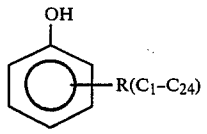

with sulfur monochloride or sulfur dichloride. Such reaction is well known and is reported in U.S. Pat. No. 2,916,454 (Bradley et al), the disclosure of which is incorporated by reference herein.

As reported by Bradley et al, the relative proportions of the alkyl phenol and sulfur compound used greatly affect the resulting product. For instance, in accord with Bradley et al, three possible products of the reaction include "(1) A product prepared by the reaction of 4 mols of a monoalkyl-substituted phenol with 3 mols of sulfur dichloride:

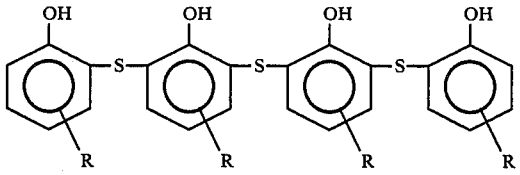

where R represents an alkyl radical.

(2) A product prepared from 2 mols of an alkyl phenol with 1 mol of sulfur dichloride:

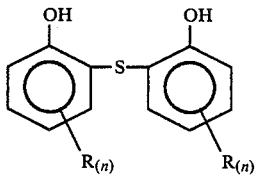

where R represents an alkyl radical and n is an integer from 1 to 4.

(3) A product prepared from an alkyl phenol with sulfur dichloride in a 1:1 mol ratio:

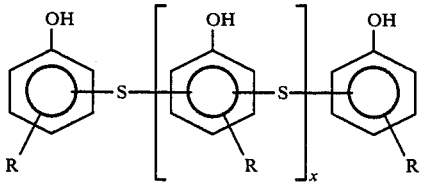

where R represents an alkyl radial and x is an integer of 2 to about 6. These products are usually referred to as phenol sulfide polymers."

In addition to products such as the above, as Bradley et al state, the phenol sulfide reaction products may, in many cases, comprise minor amounts of mixtures of various phenol sulfides such as

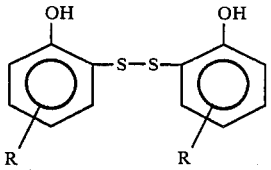

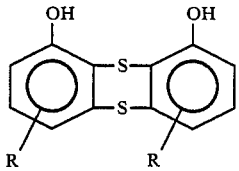

and

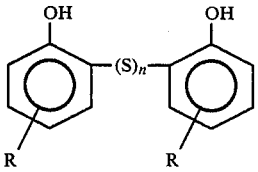

wherein n may be 3 to about 6.

These alkyl phenol sulfides are then partially or completely esterified via reaction with phosphoric acid to produce alkyl phosphonate phenate sulfides (PPS) which may be used as an antifoulant treatment in accordance with the invention.

It is preferred to only partially esterify the available hydroxyls with $H_3PO_4$ and then to react the partially phosphonated product with the oxides or hydroxides of alkaline earth metals such as $Ca(OH)_2$, CaO, $M_gO$, $M_g(OH)_2$, etc. In this manner, alkaline earth metal alkyl phosphonate phenate sulfides are prepared. Such reactions are discussed at Column 4 of U.S. Pat. No. 4,123,369 (Miller et al), incorporated by reference herein. The preferred antifoulant of the invention is a slightly over based calcium alkyl phosphonate phenate sulfide (CPPS) though to be produced by the reaction scheme specified in columns 3 and 4 of that patent.

In lieu of utilization of the PPS or CPPS materials as antifoulants in accordance with the invention, one can neutralize PPS with ammonia and/or amines such as alkylamines, arylamines, cycloalkylamines, alkanolamines, fatty amines, oxyalkylene amines, and hydroxylated polyamines. Exemplary alkylamines include, but are not limited to ethylamine, propylamine, butylamine, dibutylamine, and the like. Exemplary arylamines include, but are not limited to, aniline, benzolaniline, benzylphenylamine, and the like. Exemplary cycloalkylamines include, but are not limited to, cyclohexylamine and the like. Exemplary alkanolamines include, but are not limited to, monoethanolamine, diethanolamine, triethanolamine, bis-(2-hydroxyethyl)butylamine, N-phenyldiethanolamine, diisopropanolamine, triisopropanolamine, and bis-(2-hydroxypropyl)cocoamine. Exemplary fatty amines include, but are not limited to, cocoamine, tallowamine, cetylamine, heptadecylamine, n-octylamine, n-decylamine, laurylamine, and myristylamine. Exemplary oxyalkylene amines include, but are not limited to, the "Jeffamine$^R$" series of mono, di, and triamines which are available from Texaco Chemical Company. Exemplary hydroxylated polyamines include, but are not limited to, N,N,N',N'-tetrakis-(2-hyroxypropyl)-ethylenediamine or N,N',N'-tris-(2-hydroxyethyl)-N-tallow-1,3-diaminopropane. The resulting amine neutralized alkyl phosphonate phenate sulfide (APPS) has demonstrated antifoulant efficacy in the test systems employed in the examples.

The antifoulants may be dispersed within the liquid hydrocarbonaceous medium in need of antifouling protection in an amount of from 0.5–10,000 ppm based upon one million parts of the liquid hydrocarbon medium. Preferably, the antifoulant is added in an amount of from 1 to 500 ppm.

As used herein, the phase "liquid hydrocarbonaceous medium" signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residual, etc., may all be benefitted by using the antifoulant treatments herein disclosed and claimed.

Similarly, petrochemicals such as olefinic or naphthenic process streams, ethylene glycol, aromatic hydrocarbons and their derivatives may all be successfully treated using the inventive treatments herein described and claimed.

EXAMPLES

The invention will now be further described with reference to a number of specific examples which are to be regarded solely as illustrative and not as restricting the scope of the invention.

DUAL FOULING APPARATUS TESTS

In order to ascertain the antifoulant efficacy of the antifoulant treatment in accordance with the invention, process fluid is pumped from a pressure vessel through a heat exchanger containing an electrically heated rod. Then, the process fluid is chilled back to room temperature in a water cooled condenser before being remixed with the fluid in the pressure vessel. The system is pressurized by nitrogen to minimize vaporization of the process fluid.

In this particular set of examples, the rod temperature is controlled at a desired temperature. As fouling occurs, less heat is transferred to the fluid so that the process fluid outlet temperature decreases. Accordingly, antifoulants are said to provide antifouling protection based on the percent reduction in the oil outlet ΔT when compared to a control sample (no antifoulant present) in accordance with the equation:

$$\frac{\Delta T \text{ proc. fl. (contl.)} - \Delta T \text{ proc. fl. (antifoulant spl.)}}{\Delta T \text{ process fluid (control)}} \times 100 = \%\ \text{protection}$$

Antifoulant compounds are diluted to an appropriate activity (20–30 wt. %) and are compared at similar active dosages to untreated experiments.

Results are reported in Table I.

TABLE I

| Active Additive, Dose (ppm) | | Rod Temp | −ΔT | % Protection |
|---|---|---|---|---|
| Process Fluid - Crude Oil - Ohio Refinery | | | | |
| Blank | (Control) | 920° F. | 92 (Avg. 2 runs) | — |
| Example 1 CPPS | 206 | 920° F. | 14 | 85 |
| Comparative Example "A" | 208 | 920° F. | 64 | 30 |

TABLE I-continued

| Active Additive, Dose (ppm) | | Rod Temp | −ΔT | % Protection |
|---|---|---|---|---|
| Polyalkenyl Succinimide (PAS) | | | | |
| Process Fluid - Crude Oil - Pennsylvania Refinery | | | | |
| Blank | (Control) | 930° F. | 70 (Avg. 3 runs) | — |
| PAS | 208 | 930° F. | 89 | −27 |
| CPPS | 206 | 930° F. | 27 | 61 |
| Process Fluid - Crude Oil - Ohio Refinery | | | | |
| Blank | (Control) | 880° F. | 37 (Avg. 7 runs) | — |
| CPPS | 103 | 880° F. | 5 (Avg. 5 runs) | 86 (Avg.) |
| PAS | 104 | 880° F. | 20 (Avg. 3 runs) | 46 (Avg.) |
| Process Fluid - Crude Oil - New Jersey Refinery | | | | |
| Blank | (Control) | 750° F. | 39 (Avg. 3 runs) | — |
| PAS | 104 | 750° F. | 16 (Avg. 2 runs) | 59 (Avg.) |
| CPPS | 103 | 750° F. | 20 (Avg. 2 runs) | 49 (Avg.) |
| Process Fluid - Crude Oil - Texas Refinery | | | | |
| Blank | (Control) | 800° F. | 62 (Avg. 4 runs) | — |
| CPPS | 103 | 800° F. | 38 (Avg. 2 runs) | 39 (Avg.) |
| PAS | 104 | 800° F. | 70 (Avg. 3 runs) | −13 (Avg.) |

Another set of tests was run on a test system similar to that described hereinabove in relation to Table I except that the process fluid is run once-through the heat exchanger instead of recirculating. Also, in these particular tests, the outlet temperature of the process fluid is maintained at a desired temperature. As fouling occurs, less heat is transferred to the process fluid, which is sensed by a temperature controller. More power is then supplied to the rod which increases the rod temperature so as to maintain the constant temperature of the process fluid outlet from the heat exchanger. The degree of fouling is therefore commensurate with the increase in rod temperature ΔT compared to a control. Results are reported in Table II.

TABLE II

| Active Additive, Dose (ppm) | | Temp ° F. | ΔT | % Protection |
|---|---|---|---|---|
| Process Fluid - Crude Oil - Indiana Refinery | | | | |
| Blank | (Control) | 680 | 146 (Avg. 4 runs) | — |
| PAS | 416 | 680 | 15 (Avg. 2 runs) | 90 (Avg.) |
| CPPS | 412 | 680 | 40 | 73 |
| Blank | (Control) | 710 | 75 (Avg. 5 runs) | — |
| PAS | 416 | 710 | 62 (Avg. 2 runs) | 18 (Avg.) |
| CPPS | 412 | 710 | 30 | 60 |
| CPPS | 206 | 710 | 10 | 87 |
| Process Fluid - Crude Oil - Texas Refinery | | | | |
| Blank | (Control) | 625 | 95 (Avg. 3 runs) | — |
| PAS | 208 | 625 | 59 | 38 |
| CPPS | 206 | 625 | 80 (Avg. 2 runs) | 16 (Avg.) |
| CPPS | 412 | 625 | 61 | 36 |

Another series of tests was run on the test system described hereinabove in relation to Table II. This time, the rod temperature was controlled. The antifoulant efficacy of the various treatments was determined by the equation used in connection with Table I. Results are reported in Table III.

TABLE III

| Active Additive, Dose (ppm) | | Rod Temp °F. | −ΔT | % Protection |
|---|---|---|---|---|
| Process Fluid - Crude Oil - Texas Refinery | | | | |
| Blank | (Control) | 800 | 93 (Avg. 2 runs) | — |
| CPPS | 412 | 800 | 36 | 61 |
| PAS | 416 | 800 | 42 | 55 |
| Blank | (Control) | 750 | 96 (Avg. 3 runs) | — |
| CPPS | 412 | 750 | 54 | 44 |
| PAS | 416 | 750 | 79 | 18 |
| PAS | 208 | 750 | 64 (Avg. 2 runs) | 34 (Avg.) |
| Process Fluid - Crude Oil - Indiana Refinery | | | | |
| Blank | (Control) | 870 | 56 (Avg. 2 runs) | — |
| PAS | 416 | 870 | 29 | 48 |
| CPPS | 412 | 870 | 38 | 32 |
| Process Fluid - Crude Oil - Indiana Refinery | | | | |
| Blank | (Control) | 875 | 88 (Avg. 2 runs) | — |
| PAS | 416 | 875 | 63 | 28 |
| CPPS | 412 | 875 | 67 | 23 |

In all of the above tests, CPPS is a calcium phosphonate phenate sulfide which is commercially available. Chemical properties of the CPPS used are:

| | Typical |
|---|---|
| Calcium % wt. | 1.65 |
| Phosphorus % wt. | 1.1 |
| Sulfur % wt. | 3.6 |
| Specific Gravity | 0.95 |
| Total Base Number | 46 |
| Viscosity at 100° C., cSt | 45 |

PAS in the above tests is a well known polyalkenyl succinimide antifoulant thought to have the structure:

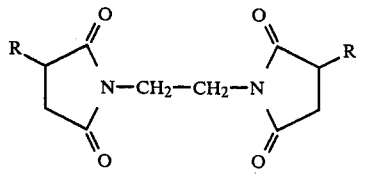

where R is polyisobutylene.

Another series of tests and comparative tests were run on the Dual Fouling Apparatus described hereinabove. Results are reported in Table IV and V.

TABLE IV

| Additive | PPM, Active | −ΔT | % Protection[1] |
|---|---|---|---|
| Dual Fouling Apparatus Results | | | |
| Texas Refinery Crude Oil - 920 F. Rod Temperature | | | |
| Blank | 0 | 90(avg 4 runs) | 0(avg) |
| EXAMPLE 1 Calcium Phosphonate-phenate Sulfide (CPPS) | 200 | 14 | 84 |
| COMPARATIVE EX. A Polyalkenyl Succinimide (PAS) | 250 | 64 | 29 |
| COMPARATIVE EX. B Calcium Sulfurized Phenate (CSP) | 200 | 119 | −32 |
| Pennsylvania Refinery Crude Oil - 930 F. Rod Temperature | | | |
| Blank | 0 | 70(avg 3 runs) | 0(avg) |
| EXAMPLE 1 (CPPS) | 400 | 27 | 61 |
| COMPARATIVE EX. A (PAS) | 500 | 87(avg 2 runs) | −24(avg) |
| Louisiana Refinery Crude Oil - 925 F. Rod Temperature | | | |
| Blank | 0 | 51(avg 10 runs) | 0(avg) |
| EXAMPLE 1 (CPPS) | 400 | 15 | 71 |
| | 500 | 26(avg 2 runs) | 49(avg) |
| COMPARATIVE EX. A (PAS) | 500 | 42(avg 3 runs) | 18(avg) |
| | 1250 | 27 | 47 |
| COMPARATIVE EX. C (CSP) | 500 | 62 | −22 |
| Australian Refinery Crude Oil - 780 F. Rod Temperature | | | |
| Blank | 0 | 54(avg 10 runs) | 0(avg) |
| EXAMPLE 1 (CPPS) | 125 | 25(avg 2 runs) | 54(avg) |
| COMPARATIVE EX. A (PAS) | 125 | 55(avg 3 runs) | −1(avg) |

[1]% PROTECTION = [1 - ΔT(TREAT)/AVGΔT(UNTREAT)] * 100

TABLE V

| Additive | PPM, Active | ΔArea | % Protection[2] |
|---|---|---|---|
| Dual Fouling Apparatus Results | | | |
| Wyoming Refinery Crude Oil - 750 F. Rod Temperature | | | |
| Blank | 0 | 44.0(avg 4 runs) | 0(avg) |
| EXAMPLE 1 (CPPS) | 250 | 30.5(avg 2 runs) | 31(avg) |
| COMPARATIVE EX. A (PAS) | 250 | 36.3 | 18 |
| Colorado Refinery Crude Oil - 940 F. Rod Temperature | | | |
| Blank | 0 | 14.2(avg 3 runs) | 0(avg) |
| EXAMPLE 1 (CPPS) | 250 | 5.6(avg 3 runs) | 55(avg) |
| Alternate Colorado Refinery Crude Oil 800 F. Rod Temperature | | | |
| Blank | 0 | 21.1(avg 3 runs) | 0(avg) |
| EXAMPLE 1 (CPPS) | 125 | 9.6(avg 2 runs) | 55(avg) |
| | 250 | 4.7 | 78 |
| COMPARATIVE EX. A (PAS) | 125 | 6.8 | 68 |
| Ohio Refinery Crude Oil - 800 F. Rod Temperature | | | |
| Blank | 0 | 45.0(avg 7 runs) | 0(avg) |
| EXAMPLE 1 (CPPS) | 250 | 38.6(avg 2 runs) | 14(avg) |
| | 500 | 37.4 | 17 |
| EXAMPLE 2 Phosphonate-phenate Sulfide (PPS) | 250 | 40.0 | 11 |
| | 500 | 37.9 | 16 |
| EXAMPLE 3 Triethanolamine/PPS | 250 | 26.7 | 41 |
| Alternate Texas Refinery Crude Oil 900 F. Rod Temperature | | | |
| Blank | 0 | 42.9(avg 4 runs) | 0(avg) |
| EXAMPLE 1 (CPPS) | 125 | 20.5 | 52 |
| | 250 | 19.1 | 56 |
| EXAMPLE 2 (PPS) | 125 | 14.2 | 67 |
| | 250 | 12.9 | 70 |
| EXAMPLE 3 (TEA/PPS) | 125 | 15.4 | 64 |
| COMPARATIVE EX. A (PAS) | 125 | 19.7 | 54 |

[2]% Protection = [1- Area(Treat)/Avg Area(Untreat)]*100

The method used to calculate the % protection in Table V differs from that used for the data in Tables I–IV.

[2] % Protection=[1− Area(Treat)/Avg Area(Untreat)]*100 For Table V, antifoulant protection was determined by comparing the summed areas under the fouling curves of the oil outlet temperatures for control, treated and ideal (nonfouling) runs. In this method, the temperatures of the oil inlet and outlet and rod temperatures at the oil inlet (cold end) and outlet (hot end) are used to calculate U-rig coefficients of heat transfer every 30 minutes during the tests. From these U-rig coefficients, areas under the fouling curves are calculated and summed over the tests for the control and treatments. The ideal case is represented as the summed area using the highest U-rig coefficients. Comparing the areas of control runs (averaged) and treated runs vs the ideal area in the following equation results in a percent protection value for antifoulants.

$$\frac{\text{Area (treatment)} - \text{Area (control)}}{\text{Area (ideal)} - \text{Area (control)}} * 100 = \%\ \text{protection}$$

In Tables IV and V, comparative Example A is a commercially available polyalkenylsuccinimide process antifoulant. Comparative Example B is a commercially available overbased calcium phenate, which, in contrast to the compounds useful in the present invention, has not been reacted with $H_3PO_4$ in order to form phosphonate esters with at least a portion of the hydroxyl hydrogen atoms of the phenol ring. Comparative Example C, is thought to be similar to comparative Example B but is sold under another trademark. The comparative Example B and C products are commonly used in industry as lubricating oil additives which, for instance, may be used as detergent/ dispersants in diesel engine crankcase lubricants.

As per Tables I–III, CPPS, is a calcium phosphonate phenate sulfide which is commercially available. The Example 2 material alkyl phosphonate phenate sulfide (PPS), is reputedly produced by first preparing an alkyl phenol sulfide by reacting an alkyl phenol with sulfur monochloride or sulfur dichloride in accordance with the procedures detailed in column 3 of U.S. Pat. No. 4,123,369 (Miller et al). The resulting alkyl phenol sulfide is then reacted with $H_3PO_4$ so that at least a portion of the H atoms of the hydroxyl functionality are esterified to form phosphonate groups. The PPS composition has similar chemical properties to the CPPS material shown hereinabove but does not contain any calcium and does not exhibit a TBN.

The Example 3 material was formed by neutralizing PPS (Example 2) with an amine, here triethanolamine. The Example 3 material was prepared via reaction of $6.6\times10^{-3}$ moles of triethanolamine and about $4.0\times10^{-3}$ moles of PPS. The Example 3 material has similar chemical properties compared to the CPPS given hereinabove, but contains no calcium and about 0.84% nitrogen.

As the examples clearly demonstrate, use of the antifoulants of the present invention, provide significant improvement over the well known, commercially available antifoulant PAS. Also, the examples of the present invention provide much higher antifoulant efficacy than Comparative Examples B or C, calcium sulfurized phenates frequently used as lubricating oil detergent/dispersants.

In accordance with the patent statues, the best mode of practicing the invention has been set forth. However, it will be apparent to those skilled in the art that many other modifications can be made without departing from the invention herein disclosed and described, the scope of the invention being limited only by the scope of the attached claims.

What is claimed is:

1. A method of inhibiting fouling deposit formation in a liquid hydrocarbonaceous medium during heat processing of said medium, wherein in the absence of such fouling inhibition, fouling deposits are normally formed as a separate phase within said medium, said method comprising adding to said medium an alkyl phosphonate phenate sulfide antifoulant compound formed from reaction of an alkyl ($C_2$–$C_{24}$) phenol sulfide and phosphoric acid wherein said heat processing is conducted at a temperature of from about 600°–1000° F.

2. A method as claimed in claim 1 wherein from about 0.5 to 10,000 parts of said antifoulant are added per one million parts of said medium.

3. A method as claimed in claim 1 wherein said alkyl phosphonate phenate sulfide is an overbased alkaline earth metal alkyl phosphonate phenate sulfide.

4. A method as claimed in claim 3 wherein said overbased alkaline earth metal alkyl phosphonate phenate sulfide is a calcium or magnesium alkyl phosphonate phenate sulfide.

5. A method as claimed in claim 4 wherein said alkaline earth metal alkyl phosphonate phenate sulfide is calcium alkyl phosphonate phenate sulfide.

6. A method as claimed in claim 5 wherein said alkaline earth metal alkyl phosphonate phenate sulfide is magnesium alkyl phosphonate phenate sulfide.

7. A method as claimed in claim 1 wherein said alkyl phosphonate phenate sulfide is an amine neutralized alkyl phosphonate phenate sulfide.

8. A method as claimed in claim 7 wherein said amine neutralized alkyl phosphonate phenate sulfide comprises alkanolamine neutralized alkyl phosphonate phenate sulfide.

9. A method as recited in claim 1 comprising adding from about 1 to 500 parts of said antifoulant compound to said medium, based upon one million parts of said hydrocarbonaceous medium.

10. A method of inhibiting fouling in a liquid hydrocarbon medium during heat treatment of said medium, wherein in the absence of such fouling inhibition, fouling deposits would normally be formed, said method comprising adding from about 0.5–10,000 parts of an antifoulant compound to said hydrocarbon medium per one million parts of said medium, said antifoulant compound being selected from the group consisting of slightly overbased alkaline earth alkyl phosphonate phenate sulfides, alkyl phosphonate phenate sulfides, amine neutralized alkyl phosphonate phenate sulfides and mixtures thereof where said heat treatment is conducted at a temperature of from about 600°–1000° F.

11. A method as recited in claim 10 wherein said medium is heated to a temperature of about 600°–1000° F.

12. A method as recited in claim 10 wherein said antifoulant is an alkaline earth alkyl phosphonate phenate sulfide.

13. A method as recited in claim 10 wherein said antifoulant is an alkyl phosphonate phenate sulfide.

14. A method as recited in claim 10 wherein said antifoulant is an amine neutralized alkyl phosphonate phenate sulfide.

15. A method as recited in claim 14 wherein said antifoulant is an alkanolamine neutralized alkyl phosphonate phenate sulfide.

16. A method as recited in claim 15 wherein said antifoulant is triethanolamine neutralized alkyl phosphonate phenate sulfide.

17. A method as recited in claim 12 wherein said antifoulant compound is a slightly overbased calcium alkyl phosphonate phenate sulfide.

18. A method of inhibiting fouling deposit formation in a liquid hydrocarbonaceous medium during heat processing of said medium comprising:

heating said medium at a temperature of from about 600°–1000° F., wherein in the absence of such fouling inhibition, fouling deposits are normally formed as a separate phase within said medium, and inhibiting said fouling deposit formation by adding to said medium an alkyl phosphonate phenate sulfide antifoulant compound formed from reaction of an alkyl ($C_1$–$C_{24}$) phenol sulfide and phosphoric acid.

* * * * *

UNITED STATES PATENT AND TRADEMARK OFFICE

CERTIFICATE OF CORRECTION

PATENT NO. : 4,828,674

DATED : May 9, 1989

INVENTOR(S) : Forester

It is certified that error appears in the above-identified patent and that said Letters Patent is hereby corrected as shown below:

Col. 2, line 2, change "of" to --- or ---.

Col. 2, line 5, change "alkly" to --- alkyl ---.

Col. 4, line 42, change "though" to --- thought ---.

Col. 9, line 1, delete "2 % Protection = [1-Area(Treat)/Avg Area (Untreat)]*100"

Signed and Sealed this

Tenth Day of December, 1991

*Attest:*

HARRY F. MANBECK, JR.

*Attesting Officer*

*Commissioner of Patents and Trademarks*